US010807092B2

(12) United States Patent
Chung et al.

(10) Patent No.: US 10,807,092 B2
(45) Date of Patent: Oct. 20, 2020

(54) MICROFLUIDIC CONTROL SYSTEM AND MICROFLUIDIC CONTROL METHOD USING THE SAME

(71) Applicant: ELECTRONICS AND TELECOMMUNICATIONS RESEARCH INSTITUTE, Daejeon (KR)

(72) Inventors: Kwang Hyo Chung, Daejeon (KR); Jin Tae Kim, Daejeon (KR); Eun-Ju Jeong, Daejeon (KR); Bong Kyu Kim, Daejeon (KR); Chang-Geun Ahn, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 304 days.

(21) Appl. No.: 15/903,325

(22) Filed: Feb. 23, 2018

(65) Prior Publication Data

US 2018/0264467 A1 Sep. 20, 2018

(30) Foreign Application Priority Data

Mar. 15, 2017 (KR) ..... 10-2017-0032724
Nov. 16, 2017 (KR) ..... 10-2017-0153305

(51) Int. Cl.
*B01L 3/00* (2006.01)
*F04B 19/00* (2006.01)
*B01L 7/00* (2006.01)

(52) U.S. Cl.
CPC ..... *B01L 3/50273* (2013.01); *B01L 3/502707* (2013.01); *B01L 3/502715* (2013.01);
(Continued)

(58) Field of Classification Search
CPC ..... B01L 3/50273; B01L 3/502715; B01L 7/525; B01L 3/502746; B01L 3/502707; B01L 2300/1822; B01L 2300/0816; B01L 2300/1805; B01L 2300/087; B01L 2400/0481; B01L 2300/0636;
(Continued)

(56) References Cited

U.S. PATENT DOCUMENTS 8,074,598 B2 12/2011 Jones et al.
9,266,105 B2 2/2016 Beachner et al.
(Continued)

FOREIGN PATENT DOCUMENTS

CN 105370917 A 3/2016

*Primary Examiner* — Lore R Jarrett

(57) ABSTRACT

The present disclosure relates to a microfluidic control system and a microfluidic control method using the same. The microfluidic control system includes: a microfluidic chip including a storage chamber for storing a reaction solution and a receiving chamber communicating with the storage chamber; and a microfluidic control device for controlling the reaction solution inside the microfluidic chip, wherein the microfluidic control device includes: a first roller which is in contact with the microfluidic chip and rotates together with the movement of the microfluidic chip; and a pressurizing protrusion formed on the outer peripheral surface of the first roller, wherein the pressurizing protrusion has a shape corresponding to the storage chamber.

16 Claims, 15 Drawing Sheets

(52) U.S. Cl.
CPC ..... *B01L 3/502746* (2013.01); *B01L 7/525* (2013.01); *F04B 19/006* (2013.01); *B01L 2300/0636* (2013.01); *B01L 2300/087* (2013.01); *B01L 2300/0816* (2013.01); *B01L 2300/0819* (2013.01); *B01L 2300/0867* (2013.01); *B01L 2300/123* (2013.01); *B01L 2300/16* (2013.01); *B01L 2300/1805* (2013.01); *B01L 2300/1822* (2013.01); *B01L 2300/1894* (2013.01); *B01L 2400/0481* (2013.01)

(58) Field of Classification Search
CPC ..... B01L 2300/1894; B01L 2300/123; B01L 2300/16; B01L 2300/0819; B01L 2300/0867; B01L 3/5023; B01L 2200/0689; B01L 2300/126; B01L 2300/161; F04B 19/006; B32B 29/005; B32B 37/06; B32B 7/12; B32B 37/12; B32B 41/00; B32B 38/1841; B32B 33/00; B32B 2535/00; B32B 37/0076; B32B 38/145; B32B 2391/00; B32B 37/0053; B32B 2255/12; B32B 2309/02; B32B 37/1292; B32B 2307/73; B32B 2317/12; B32B 37/1207; Y10T 156/1741; G01N 21/75; G01N 2035/00108
See application file for complete search history.

(56) References Cited

U.S. PATENT DOCUMENTS

| | | | | |
|---|---|---|---|---|
| 2002/0098124 | A1* | 7/2002 | Bentsen | B29C 43/222 422/502 |
| 2004/0231736 | A1 | 11/2004 | Kim et al. | |
| 2010/0317093 | A1 | 12/2010 | Turewicz et al. | |
| 2013/0212882 | A1 | 8/2013 | Lee et al. | |
| 2015/0367340 | A1* | 12/2015 | Beachner | B01L 3/502707 422/430 |
| 2015/0367341 | A1* | 12/2015 | Zhou | B01L 3/502746 422/430 |

* cited by examiner

MICROFLUIDIC CONTROL SYSTEM AND MICROFLUIDIC CONTROL METHOD USING THE SAME

CROSS-REFERENCE TO RELATED APPLICATIONS

This U.S. non-provisional patent application claims priority under 35 U.S.C. § 119 of Korean Patent Application Nos. 10-2017-0032724, filed on Mar. 15, 2017, and 10-2017-0153305, filed on Nov. 16, 2017, the entire contents of which are hereby incorporated by reference.

BACKGROUND

The present disclosure herein relates to a microfluidic control system and a microfluidic control method using the same, and more particularly, to a microfluidic control system capable of precisely transferring a reaction solution and a microfluidic control method using the same.

There have been developed biochips for easily and quickly diagnosing and analyzing a biological sample. The biochips include a method of introducing only the biological sample and a method of sequentially introducing various reaction solutions. The former has the advantage of being a simple form, but it is not applicable to diagnostic analysis requiring complicated biochemical reactions. The latter has the advantage of being capable of complicated reaction and applying various analytical protocols, but also requires a complicated driving device for storing and supplying the reaction solutions.

Recent development trends of biochips include the development of high-performance biochips with high sensitivity, quantification, reproducibility, and multiple simultaneous analyses. In addition, a lab-on-a-chip type biochip has been developed in which sample pretreatment, analysis and detection are sequentially performed on a single chip. Thus, in order to develop a biochip in the form of a high-performance lab-on-a-chip, a reproducible implementation of a complicated reaction protocol is required, which may be achieved a precise and automated supplying of reaction solutions. Therefore, it is necessary to study the microfluidic control system and the microfluidic control method for realizing the reproducible and precise reaction protocol.

SUMMARY

The present disclosure provides a microfluidic control system capable of precisely controlling reaction solutions and applicable to various lab-on-a chips, and a microfluidic control method using the same.

An embodiment of the inventive concept provides a microfluidic control system including: a microfluidic chip including a storage chamber for storing a reaction solution and a receiving chamber communicating with the storage chamber; and a microfluidic control device for control the reaction solution inside the microfluidic chip, wherein the microfluidic control device may include: a first roller which is in contact with the microfluidic chip and rotates together with the movement of the microfluidic chip; and a pressurizing protrusion formed on an outer peripheral surface of the first roller, wherein the pressurizing protrusion may have a shape corresponding to the storage chamber.

In an embodiment, the microfluidic chip may include a body part and a cover sheet covering the body part, wherein the storage chamber may be defined by the body part and the cover sheet.

In an embodiment, the cover sheet may have flexibility.

In an embodiment, an adhesive layer may be further included on one surface of the cover sheet facing the body part.

In an embodiment, the microfluidic chip may further include an exhaust hole for exhausting air inside the microfluidic chip, wherein the exhaust hole may communicate with the receiving chamber.

In an embodiment, the microfluidic chip may include a body part and a cover sheet covering the body part, wherein the exhaust hole may be formed inside the cover sheet and communicate with the receiving chamber by an exhaust channel formed inside the body part.

In an embodiment, the microfluidic control device may further include a second roller disposed adjacent to the first roller, wherein the microfluidic chip may be introduced into a gap between the first roller and the second roller, and the first roller and the second roller may rotate together keeping pace with the movement of the microfluidic chip.

In an embodiment, the microfluidic control device may further include an elastic member disposed inside the second roller and forming a portion of the outer peripheral surface of the second roller.

In an embodiment, the microfluidic control device may further include a driving member, wherein the driving member may be composed such that a rotational force is applied to the first roller.

In an embodiment, the microfluidic control device may further include a temperature control part disposed inside the first roller.

In an embodiment, on the outer peripheral surface of the first roller, a distance between the temperature control part and the pressurizing protrusion may be substantially the same as the distance between the storage chamber and the receiving chamber.

In an embodiment, the storage chamber and the pressurizing protrusion may have tapered shapes.

In an embodiment of the inventive concept, a microfluidic control method for including a storage chamber for storing a reaction solution and a receiving chamber communicating with the storage chamber may include: coupling the microfluidic chip to a first roller and a microfluidic control device including a pressurizing protrusion formed on an outer peripheral surface of the first roller; and rotating the first roller to pressurize the storage chamber with the pressurizing protrusion, wherein the reaction solution in the storage chamber may be transferred into the receiving chamber by the pressurizing.

In an embodiment, the microfluidic chip may include a body part and a cover sheet covering the body part, and the storage chamber may be defined by the body part and the cover sheet, wherein the pressurizing the storage chamber may include the pressurizing the cover sheet with the pressurizing protrusion.

In an embodiment, the pressurizing the cover sheet with the pressurizing protrusion may include: using pressurizing protrusion to sequentially contact the cover sheet from one point to another point on a bottom surface of the storage chamber.

In an embodiment, by the pressurizing, at least a portion of one surface of the cover sheet facing the body part may adhere to a bottom surface of the storage chamber.

In an embodiment, the microfluidic chip may move linearly while the first roller rotates, wherein the linear speed of the outer peripheral surface of the first roller may be equal to a movement speed of the microfluidic chip.

In an embodiment, the microfluidic control device may further include a temperature control part disposed inside the first roller, wherein the temperature control part may be positioned on the receiving chamber to further include controlling a temperature of the reaction solution transferred to the receiving chamber.

BRIEF DESCRIPTION OF THE FIGURES

The accompanying drawings are included to provide a further understanding of the inventive concept, and are incorporated in and compose a part of this specification. The drawings illustrate exemplary embodiments of the inventive concept and, together with the description, serve to explain principles of the inventive concept. In the drawings.

DETAILED DESCRIPTION

Figure 1:
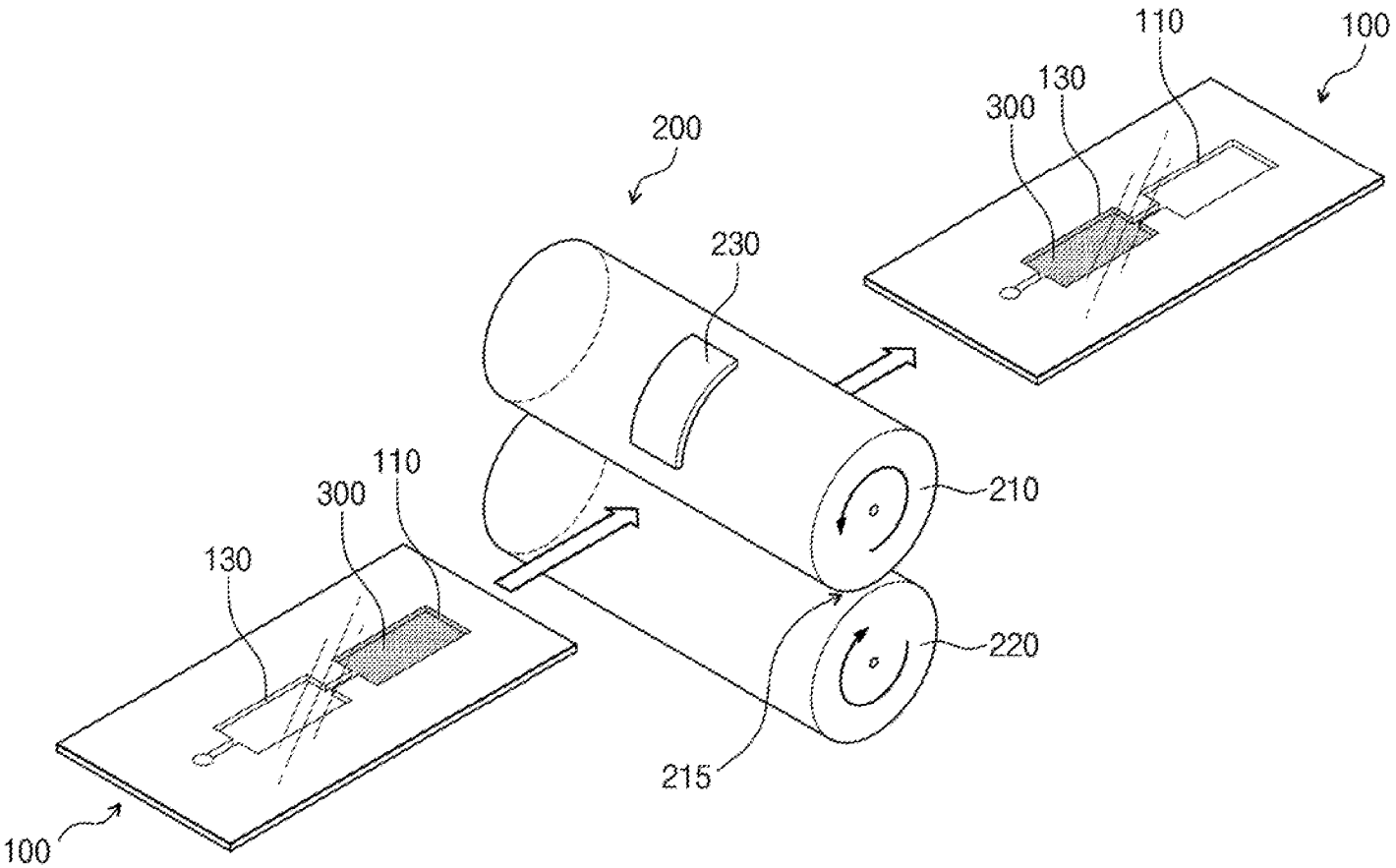
FIG. 1 is a view illustrating a microfluidic control system, according to embodiments of the inventive concept.

Advantages and features of the present invention and methods of achieving them will be apparent from and elucidated with reference to the embodiments described hereinafter in detail with reference to the accompanying drawings. The present invention may, however, be embodied in many different forms and should not be construed as limited to the embodiments set forth herein. Rather, these embodiments are provided so that this disclosure will be thorough and complete, and will fully convey the concept of the invention to those skilled in the art, and is intended to be in all likelihood understood to fall within the scope of the invention. Like reference numerals refer to like elements throughout the specification.

The terminology used herein is for the purpose of illustrating embodiments and is not intended to be limiting of the present invention. In this specification, singular forms include plural forms unless the context clearly dictates otherwise. It should be understood that the terms 'comprises' and/or 'comprising' used in the specification are intended to be inclusive in a manner that the presence of stated elements, or does not exclude the addition.

Furthermore, the embodiments described herein will be described with reference to cross-sectional views and/or plan views, which are ideal illustrations of the present invention. In the drawings, the thicknesses of the films and regions are exaggerated for an effective description of the technical content. Thus, the shape of the illustrations may be modified by manufacturing techniques and/or tolerances. Accordingly, the embodiments of the present invention are not limited to the specific forms shown, but also include changes in the shapes that are generated according to the manufacturing process. For example, the etching regions shown at right angles may be rounded or may have a shape with a certain curvature. Thus, the regions illustrated in the figures have schematic attributes, and the shapes of the regions illustrated in the figures are intended to illustrate specific types of regions of the elements and are not intended to limit the scope of the invention.

Hereinafter, embodiment of the inventive concept will be described in detail with reference to the drawings.

FIG. 1 is a view illustrating a microfluidic control system according to embodiments of the inventive concept.

Referring to FIG. 1, a microfluidic control system according to embodiments of the inventive concept may include a microfluidic chip 100 and a microfluidic control device 200. The microfluidic chip 100 may store a reaction solution 300 therein. The microfluidic chip 100 may be introduced into the microfluidic control device 200, and the microfluidic control device 200 may control the reaction solution 300 stored in the microfluidic chip 100.

Specifically, the microfluidic chip 100 may include a storage chamber 110 for storing the reaction solution 300 and a receiving chamber 130 communicating with the storage chamber 110. The microfluidic chip 100 may be introduced into the microfluidic control device 200 in a state in which the reaction solution 300 is stored in the storage chamber 110. The microfluidic chip 100 introduced into the microfluidic control device 200 may move to one direction to pass through the microfluidic control device 200.

The microfluidic control device 200 may include a first roller 210 and a second roller 220 which is adjacent to each other, and an introduction port 215 for introducing the microfluidic chip 100 interposed between the first roller 210 and the second roller 220 may be formed. On the outer peripheral surface of the first roller 210, a pressurizing protrusion 230 having a shape corresponding to the storage chamber 110 may be formed. The pressurizing protrusion 230 may pressurize the storage chamber 110 while the microfluidic chip 100 passes through the microfluidic control device 200, so that the reaction solution 300 inside the storage chamber 110 may be transferred into the receiving chamber 130. The microfluidic control device 200 may control the reaction solution 300. For example, the microfluidic control device 200 may move, fix, mix, or dispense the reaction solution in the microfluidic chip. The operation of the microfluidic control system including the microfluidic chip 100 and the microfluidic control device 200 will be described later in detail again with reference to FIGS. 10 to 15.

Figure 2:
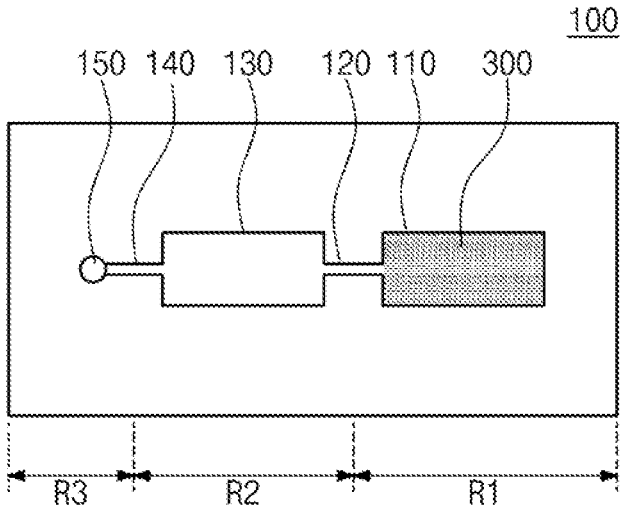
FIG. 2 is a plan view illustrating a microfluidic chip, according to embodiments of the inventive concept.
Figure 3:
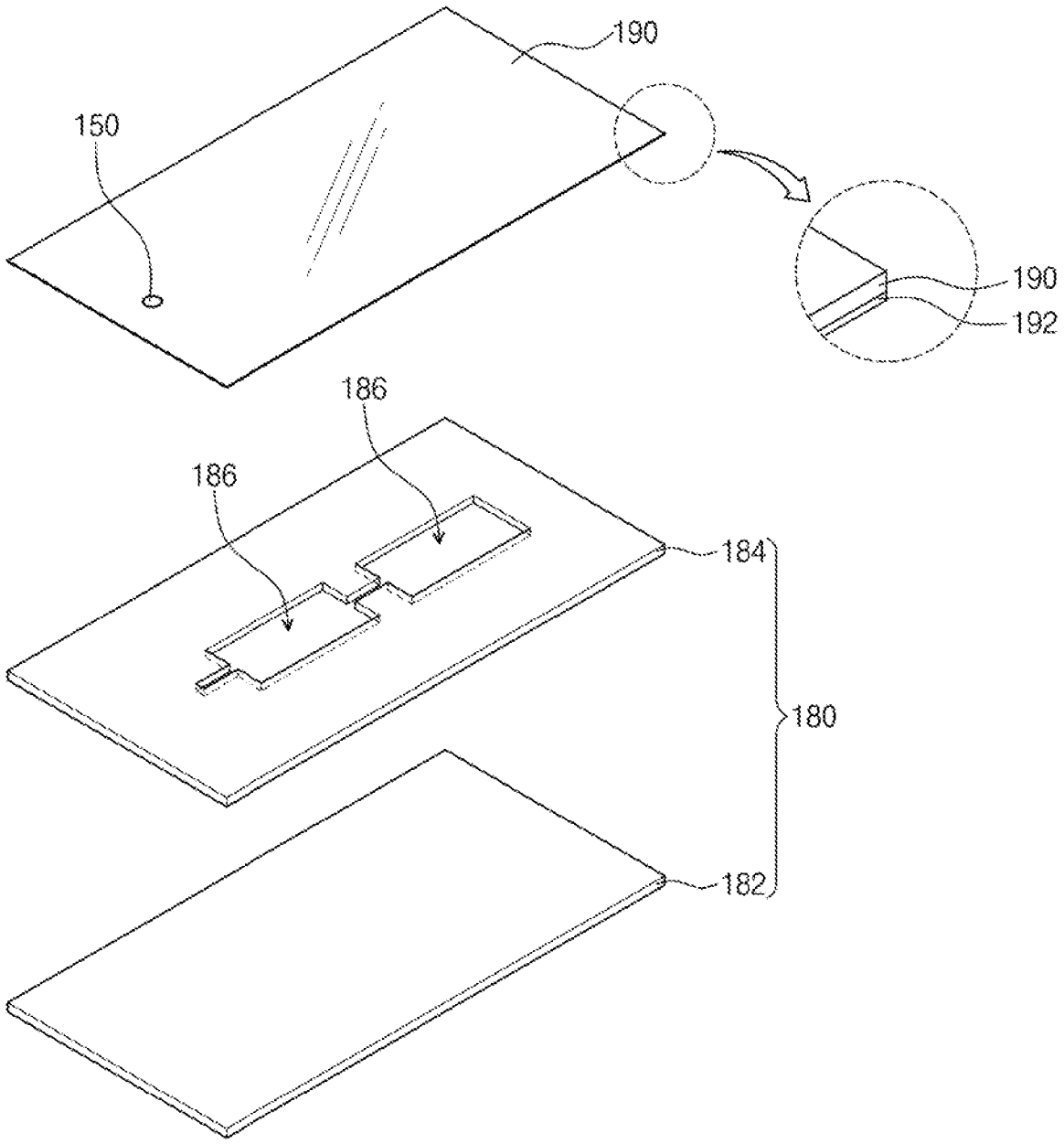
FIG. 3 a view illustrating a microfluidic chip according to embodiments of the inventive concept, which is an explored perspective view of the microfluidic chip.

FIG. 2 is a plan view illustrating a microfluidic chip according to embodiments of the inventive concept. FIG. 3 is a view illustrating a microfluidic chip according to embodiments of the inventive concept, which is an explored perspective view of the microfluidic chip.

Referring to FIGS. 2 and 3, the microfluidic chip 100 may include a storage portion R1, a receiving portion R2, and an exhaust portion R3 arranged in one direction. The storage portion R1 may be a portion for storing the reaction solution 300, and the receiving portion R2 may be a portion for receiving the reaction solution 300. The exhaust portion R3 may be a portion for exhausting air in the storage portion R1 and the receiving portion R2. The microfluidic chip 100 may be a biochip or a chemical reaction chip. The microfluidic chip 100 may be a biochip, which is, for example, an immune response chip, a gene chip, a cell reaction chip, or a cell separation chip. The microfluidic chip 100 may be a chemical reaction chip, which is, for example, a component separating chip, a fluid mixing chip, or a fluid diluting chip.

The microfluidic chip 100 may include a storage chamber 110, a transfer channel 120, a receiving chamber 130, an exhaust channel 140, and an exhaust hole 150, which are arranged in one direction. The storage chamber 110 may be formed in the storage portion R1. The storage chamber 110 may have an internal space for storing the reaction solution 300. The storage chamber 110 may have a flat bottom surface and may have a rectangular shape in a vertical view.

The receiving chamber 130 may be disposed in the receiving portion R2. The receiving chamber 130 may have an internal space for receiving the reaction solution 300 from the storage chamber 110. According to embodiments, in the receiving chamber 130, there may be provided a biomarker included in a biological sample (for example, blood, urine, saliva or the like), that is, a reaction material such as an antibody, a gene, a nano particle, a receptor, and a salt for performing a biochemical reaction with a target material. The receiving chamber 130 may be a reaction space in which the reaction material reacts with the reaction solution 300 including the target material. For example, a polymerase chain reaction may be carried out inside the receiving chamber 130. However, the embodiment of the inventive concept is merely exemplified, not limited thereto. The receiving chamber 130 may have an internal space having the same size as the internal space of the storage chamber 110. The receiving chamber 130 may have a structure similar to that of the storage chamber 110.

The transfer channel 120 may be formed between the storage chamber 110 and the receiving chamber 130. The transfer channel 120 may connect the storage chamber 110 and the receiving chamber 130. That is, the storage chamber 110 and the receiving chamber 130 communicate with each other through the transfer channel 120. The transfer channel 120 may have a tube shape such that the reaction solution 300 is delivered from the storage chamber 110 to the receiving chamber 130. The transfer channel 120 may have a smaller width and/or depth than the storage chamber 110 and the receiving chamber 130.

The exhaust hole 150 may be formed in the exhaust portion R3. The exhaust hole 150 may exhaust air inside the microfluidic chip 100 to the outside of the microfluidic chip 100. According to embodiments, the exhaust hole 150 may be disposed adjacent to the receiving chamber 130 and may be connected to the receiving chamber 130 through the exhaust channel 140. That is, the exhaust hole 150 and the receiving chamber 130 are connected to one end and the other end of the exhaust channel 140, respectively, and communicate with each other. Accordingly, the exhaust hole 150 may exhaust air inside the receiving chamber 130 to the outside of the microfluidic chip 100. The exhaust hole 150 may facilitate the transfer of the reaction solution 300. For example, when the reaction solution in the storage chamber 110 is transferred to the receiving chamber 130, the pressure in the receiving chamber 130 may be increased. The increased pressure inside the receiving chamber 130 may interfere with the transfer of the reaction solution 300. The exhaust hole 150 exhausts air inside the receiving chamber 130 to the outside of the microfluidic chip 100 while the reaction solution 300 in the storage chamber 110 is transferred to the receiving chamber 130, so that the pressure inside the receiving chamber 130 may be kept constant.

Referring back to FIGS. 2 and 3, the microfluidic chip 100 may have a structure in which a plurality of layers is stacked. The microfluidic chip 100 may include, as illustrated in FIG. 3, a body part 180 and a cover sheet 190 covering the body part 180.

The body part 180 may include a substrate 182 and an intermediate layer 184 on the substrate 182. The substrate 182 may have a flat plate structure. The substrate 182 may have a flat top surface. The intermediate layer 184 may be disposed on the substrate 182. The intermediate layer 184 may have openings 186 corresponding to shapes of the storage chamber 110, the transfer channel 120, the receiving chamber 130, and the exhaust channel 140. The body part 180 may include a material having a higher rigidity than the cover sheet 190 such that a predetermined shape may be maintained inside the microfluidic control device 200. The body part 180 may be composed of, for example, plastic, glass, metal, pulp, or a combination thereof.

The cover sheet 190 may be disposed on the top surface of the intermediate layer 184. The cover sheet 190 may have a thinner thickness and a lower rigidity than the substrate 182 and the intermediate layer 184. The cover sheet 190 may have elasticity. The cover sheet 190 may include, for example, latex, polydimethylsiloxane (PDMS), metal thin film, film, and the like. When the cover sheet 190 is pressurized by a pressurizing protrusion 230 described with reference to FIG. 1, the shape thereof may be changed. One surface of the cover sheet 190 facing the body part 180 may have an adhesive force. According to embodiments, an adhesive layer 192 may be disposed on one surface of the cover sheet 190 facing the body part 180. The cover sheet 190 may be attached to the body part 180 such that the surface having the adhesive force faces the body part 180. When the cover sheet 190 is pressurized by the pressurizing protrusion 230, at least a portion of the one surface of the cover sheet 190 may be attached to the top surface of the substrate 182. Accordingly, the backflow of the reaction solution 300 may be prevented (see FIG. 14). According to embodiments, the cover sheet 190 may adhere to the body part 180 by a lamination process of using heat without the adhesive layer 192. According to embodiments, the cover sheet 190 may be composed of a material without a restoring force. When the cover sheet 190 is pressurized by the pressurizing protrusion 230, the cover sheet 190 may be deformed such that at least a portion of the one surface of the cover sheet 190 is in contact with the top surface of the substrate 182.

A boundary surface between the storage chamber 110 and the receiving chamber 130 may be defined by the body part 180 and the cover sheet 190. Specifically, the top surface of the substrate 182 may be defined as the bottom surface of the storage chamber 110 and the receiving chamber 130. Inner surfaces of the openings 186 of the intermediate layer 184 may be defined as inner surfaces of the storage chamber 110 and the receiving chamber 130. A bottom surface of the cover sheet 190 may be defined as a top surface of the storage chamber 110 and the receiving chamber 130.

The exhaust hole 150 may be formed in the cover sheet 190 and the exhaust channel 140 may be formed in the body part 180. The exhaust hole 150 may be disposed on one end of the exhaust channel 140. The exhaust hole 150 may communicate with the receiving chamber 130 through the exhaust channel 140.

Figure 4:
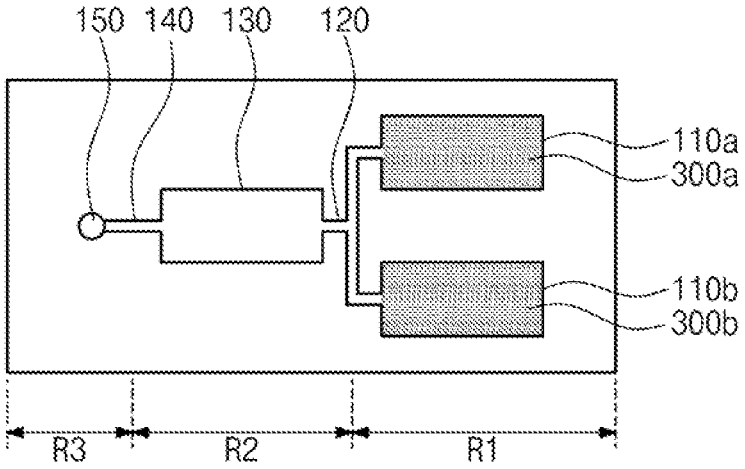
FIGS. 4 and 5 are plan views illustrating microfluidic chips, according to embodiments of the inventive concept.
Figure 5:
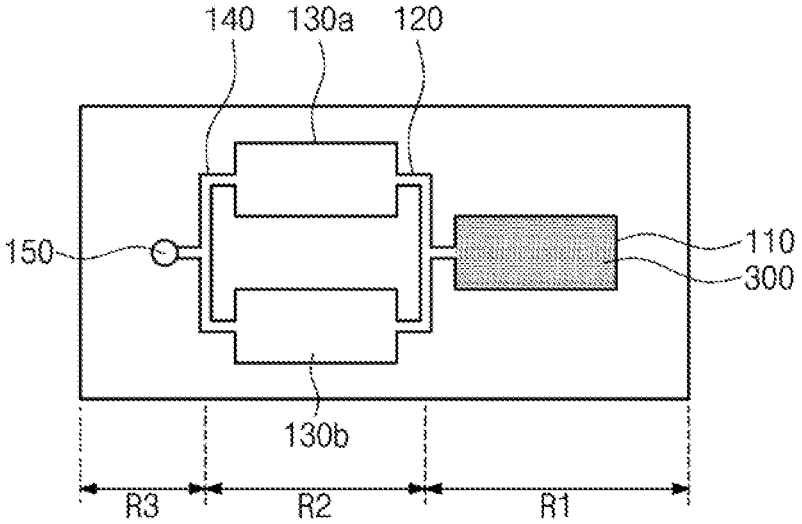

FIGS. 4 and 5 are plan views illustrating a microfluidic chip according to embodiments of the inventive concept. The difference from the microfluidic chip described with reference to FIGS. 2 and 3 will be mainly described, and detailed description of the redundant configuration will not be provided.

Referring to FIG. 4, the microfluidic chip 100 may include a first storage chamber 110A and a second storage chamber 110B. Different types of the reaction solution may be stored in the first storage chamber 110A and the second storage chamber 110B. For example, a first reaction solution 300A may be stored in the first storage chamber 110A, and a second reaction solution 300B may be stored in the second storage chamber 110B.

The transfer channel 120 may be disposed between the receiving chamber 130 and the storage chambers 110A and 110B. One end of the transfer channel 120 may be connected with the receiving chamber 130, and the other end of the transfer channel 120 may be branched into a plurality of channels to be connected with the first storage chamber 110A and the second storage chamber 110B, respectively. According to embodiments, the first reaction solution 300A and the second reaction solution 300B may be mixed inside the transfer channel 120. However, alternatively, the first reaction solution 300A and the second reaction solution 300B may be sequentially supplied into the receiving chamber 130.

Referring to FIG. 5, the microfluidic chip 100 may include a first receiving chamber 130A and a second receiving chamber 130B. For example, different reaction materials may be provided in the first receiving chamber 130A and the second receiving chamber 130B, but the embodiments of the inventive concept are not limited thereto. The exhaust channel 140 may be disposed between the receiving chambers 130A and 130B and the exhaust portion R3. One end of the exhaust channel 140 may be connected with the exhaust portion R3, and the other end of the exhaust channel 140 may be branched into a plurality of channels, and connected with the first receiving chamber 130A and the second receiving chamber 130B, respectively.

Figure 6:
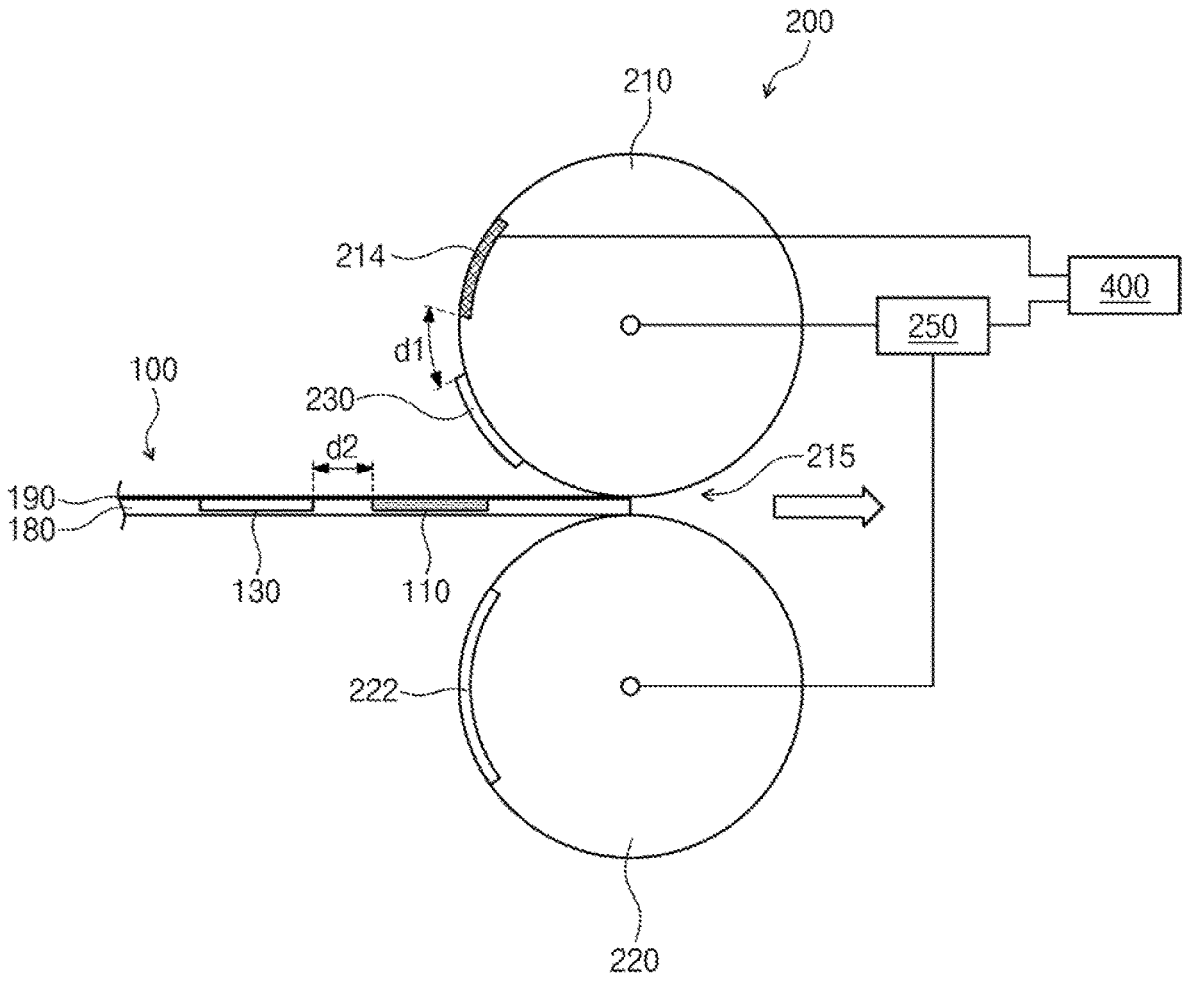
FIG. 6 is a cross-sectional view illustrating a microfluidic control system, according to embodiments of the inventive concept.

FIG. 6 is a cross-sectional view illustrating a microfluidic control system according to embodiments of the inventive concept. FIGS. 7A to 7D are enlarged cross-sectional views illustrating a first roller, according to embodiments of the inventive concept.

Referring to FIG. 6, the microfluidic control device 200 may include a first roller 210, a second roller 220, a pressurizing protrusion 230, and an elastic member 222.

The first roller 210 and the second roller 220 may be disposed adjacent to each other. An introduction port 215 may be formed between the first roller 210 and the second roller 220 such that the microfluidic chip 100 may be introduced. The first roller 210 and the second roller 220 may support the microfluidic chip 100 introduced into the introduction port 215. The microfluidic chip 100 may move linearly inside the microfluidic control device 200.

The first roller 210 and the second roller 220 may contact the microfluidic chip 100 and rotate together with the movement of the microfluidic chip 100. As an example, when a rotational force is applied to the first roller 210 and/or the second roller 220, the first roller 210 and/or the second roller 220 may apply a frictional force to the microfluidic chip 100, and accordingly, the microfluidic chip 100 may move. In another example, when an external force is applied to the microfluidic chip 100, the microfluidic chip 100 may apply the frictional force to the first roller 210 and the second roller 220, and accordingly, the first roller 210 and the second roller 220 may rotate.

The pressurizing protrusion 230 may be formed on the outer peripheral surface of the first roller 210. The pressurizing protrusion 230 may have a shape corresponding to the storage chamber 110 with a vertical view (that is, a view looking down the outer peripheral surface of the first roller 210). A detailed vertical shape of the pressurizing protrusion 230 and the storage chamber 110 will be described later with reference to FIGS. 8A to 8C.

Figure 7A:
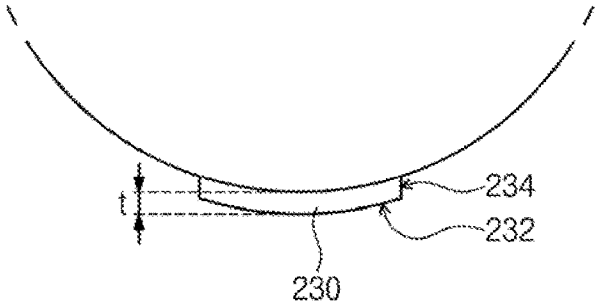
FIGS. 7A to 7D are enlarged cross-sectional views illustrating a first roller, according to embodiments of the inventive concept.

As illustrated in FIG. 7A, a first surface 232 of the pressurizing protrusion 230 contacting the microfluidic chip 100 may have a predetermined curvature such that a constant pressure may be applied. For example, the radius of curvature of the first surface 232 may be equal to the radius of the first roller 210. The pressurizing protrusion 230 may have flat side surfaces 234. Accordingly, angled edges may be formed between the first surface 232 and the side surface 234 of the pressurizing protrusion 230.

Figure 7B:
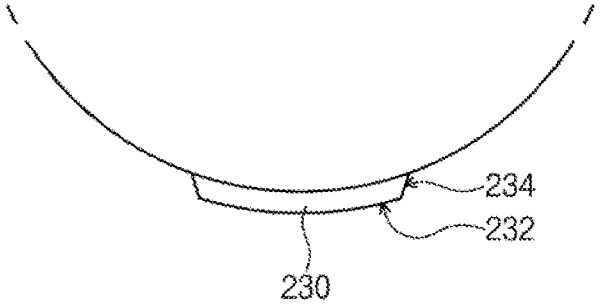

According to embodiments, as illustrated in FIG. 7B, the side surface 234 of the pressurizing protrusion 230 may be inclined toward the first surface 232 of the pressurizing protrusion 230. That is, the first surface 232 of the pressurizing protrusion 230 and the side surface of the pressurizing protrusion 230 may be formed at obtuse angles. Accordingly, the cover sheet 190 may be prevented from being damaged while pressurizing the storage chamber 110 with the pressurizing protrusion 230.

Figure 7C:
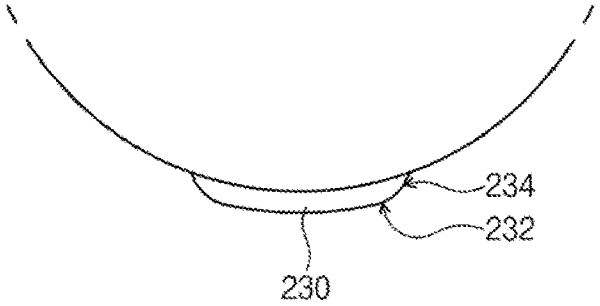

According to embodiments, as illustrated in FIG. 7C, the side surface 234 of the pressurizing protrusion 230 may have the form of a curved surface. Accordingly, the pressurizing protrusion 230 may be smoothly formed without angled edges, and the cover sheet 190 may be prevented from being damaged while pressurizing the storage chamber 110 with the pressurizing protrusion 230.

Figure 7D:
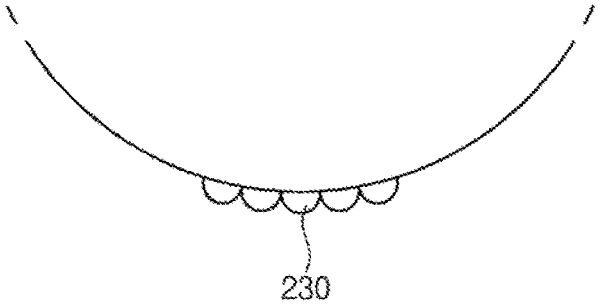

According to embodiments, as illustrated in FIG. 7D, the pressurizing protrusion 230 may include a plurality of protrusions.

The elastic member 222 may be disposed in the second roller 220 and compose a portion of the outer peripheral surface of the second roller 220. The elastic member 222 may be composed of a material such as rubber or plastic. The elastic member 222 may control the pressure applied to the microfluidic chip 100 while the first roller 210 and the second roller 220 support the microfluidic chip 100, so that destruction of the microfluidic chip 100 may be prevented.

Referring back to FIG. 6, the microfluidic control device 200 may include a driving member 250, a temperature control part 214 and a controller 400.

The driving member 250 may be connected to the first roller 210 to provide the rotational force to the first roller 210. The driving member 250 may be connected with the first roller 210 directly or indirectly. The driving member 250 may rotate the first roller 210 at a predetermined linear speed to move the microfluidic chip 100 introduced into the microfluidic control device 200. The driving member 250 may be a motor. According to embodiments, the driving member 250 may be connected to the second roller 220 rather than the first roller 210, or to both the first roller 210 and the second roller 220.

The temperature control part 214 may be disposed inside the first roller 210. The temperature control part 214 may be disposed adjacent to the outer peripheral surface of the first roller 210 or may compose a portion of the outer peripheral surface of the first roller 210. The temperature control part 214 may include a heater and/or a cooler. The temperature control part 214 may include, for example, a film heater or a thermoelectric element. In addition, the temperature control part 214 may include a temperature sensor. The temperature sensor may be, for example, a thermo-couple. The distance d1 between the temperature control part 214 and the pressurizing protrusion 230 on the outer peripheral surface of the first roller 210 may be substantially equal to the distance d2 between the storage chamber 110 and the receiving chamber 130. The temperature control part 214 may be positioned on the receiving chamber 130 according to the rotation of the first roller 210, and may adjust the temperature of the reaction solution 300 provided in the receiving chamber 130.

The controller 400 may be connected with the driving member 250 and the temperature control part 214. The controller 400 may be a combination of a central processing unit (CPU) and a memory. The controller 400 may control the driving member 250 and the temperature control part 214.

Figure 8A:
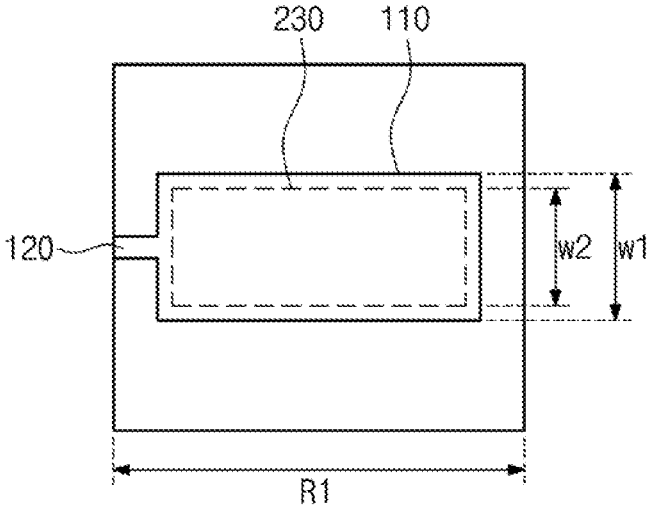
FIGS. 8A to 8C are views illustrating storage chambers and pressurizing protrusions having shapes corresponding to the storage chambers, according to embodiments of the inventive concept.
Figure 8B:
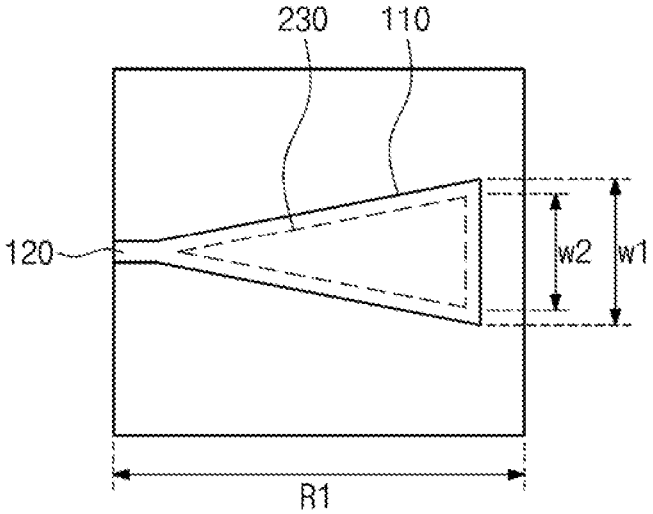
Figure 8C:
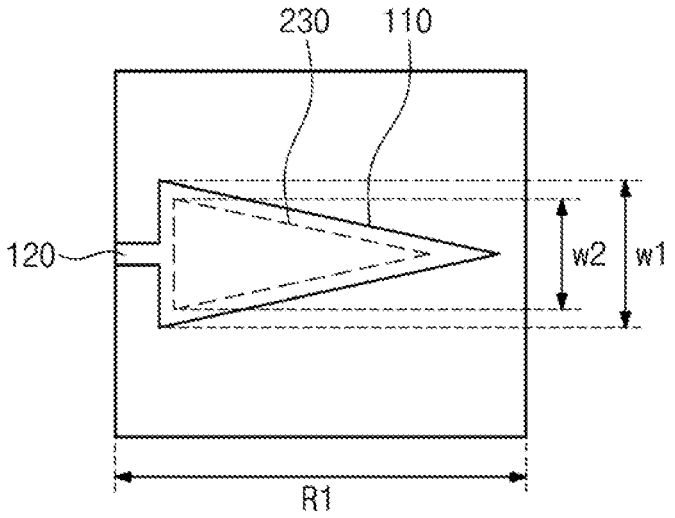

FIGS. 8A to 8C are views illustrating storage chambers and pressuring protrusions having shapes corresponding thereto according to embodiments of the inventive concept, which correspond to the storage portion of FIG. 2.

Referring to FIGS. 2 and 8A to 8C, the storage chamber 110 may extend elongated in a direction away from the receiving chamber 130. The pressurizing protrusion 230 may have a shape corresponding to the storage chamber 110. When the storage chamber 110 is pressurized by the pressurizing protrusion 230, the storage chamber 110 has a shape corresponding to the pressurizing protrusion 230, so that the reaction solution 300 inside the storage chamber 110 may be easily transferred into the receiving chamber 130.

As illustrated in FIG. 8A, the storage chamber 110 may have a rectangular shape, and a width w1 of the storage chamber 110 may be constant. Accordingly, the pressurizing protrusion 230 may have a rectangular shape, and a width w2 of the pressurizing protrusion 230 may be constant. The storage chamber 110 and the pressurizing protrusion 230 have the predetermined widths w1 and w2, and thus the speed at which the reaction solution 300 is transferred to the receiving chamber 130 may be constant while the pressurizing protrusion 230 pressurizes the storage chamber 110.

As illustrated in FIGS. 8B and 8C, the storage chamber 110 and the pressurizing protrusion 230 may have a tapered shape. The pressurizing protrusion 230 is sequentially pressurized from one point to another point of the storage chamber 110 in accordance with the rotation of the first roller 210. Thus, the widths of the storage chamber 110 and the pressurizing protrusion 230 are changed, so that the speed of transferring the reaction solution 300 may be adjusted. When the storage chamber 110 and the pressurizing protrusion 230 have a tapered shape, the speed of transferring the reaction solution 300 may gradually decrease or increase.

Specifically, as illustrated in FIG. 8B, when the width w1 of the storage chamber 110 and the width w2 of the pressurizing protrusion 230 increase as moving away from the receiving chamber 130, the speed of the reaction solution 300 transferred to the receiving chamber 130 may gradually decrease while the pressurizing protrusion 230 pressurizes the storage chamber 110. On the contrary, as illustrated in FIG. 8C, when the width w1 of the storage chamber 110 and the width w2 of the pressurizing protrusion 230 decrease as moving away from the receiving chamber 130, the speed of the reaction solution 300 transferred to the receiving chamber 130 may gradually increase while the pressurizing protrusion 230 pressurizes the storage chamber 110.

Figure 9:
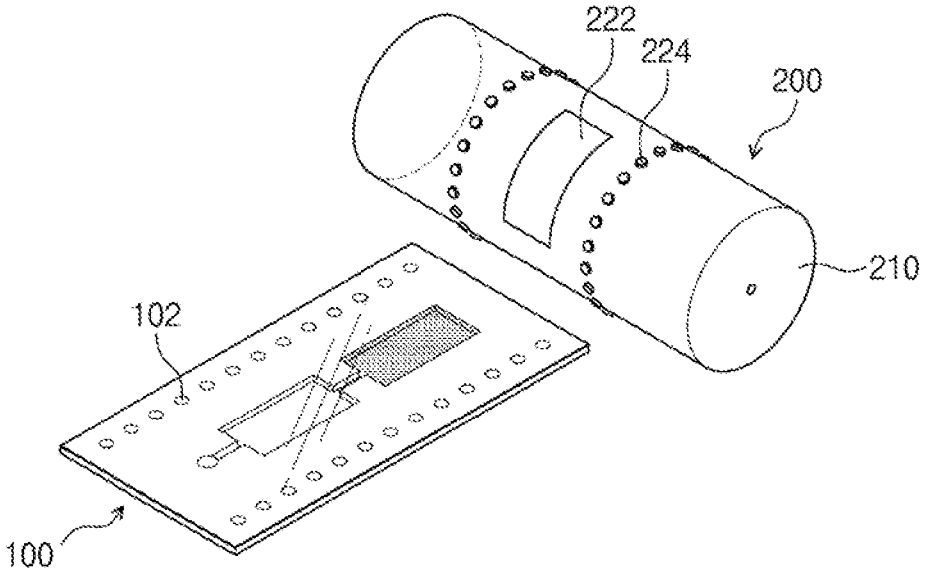
FIG. 9 is a perspective view illustrating a second roller and a microfluidic chip, according to embodiments of the inventive concept.

FIG. 9 is a perspective view illustrating the second roller and the microfluidic chip according to embodiments of the inventive concept.

Referring to FIG. 9, the microfluidic control device 200 and the microfluidic chip 100 may further include coupling members for facilitating coupling each other. For example, coupling protrusions 224 may be formed on the outer peripheral surface of the second roller 220, and coupling grooves 102 may be formed on the edge of the microfluidic chip 100. The coupling protrusions 224 and the coupling grooves 102 have a shape corresponding to each other. The coupling protrusions 224 are inserted into the coupling grooves 102 and may couple the microfluidic chip 100 to the microfluidic control device 200.

Figure 10:
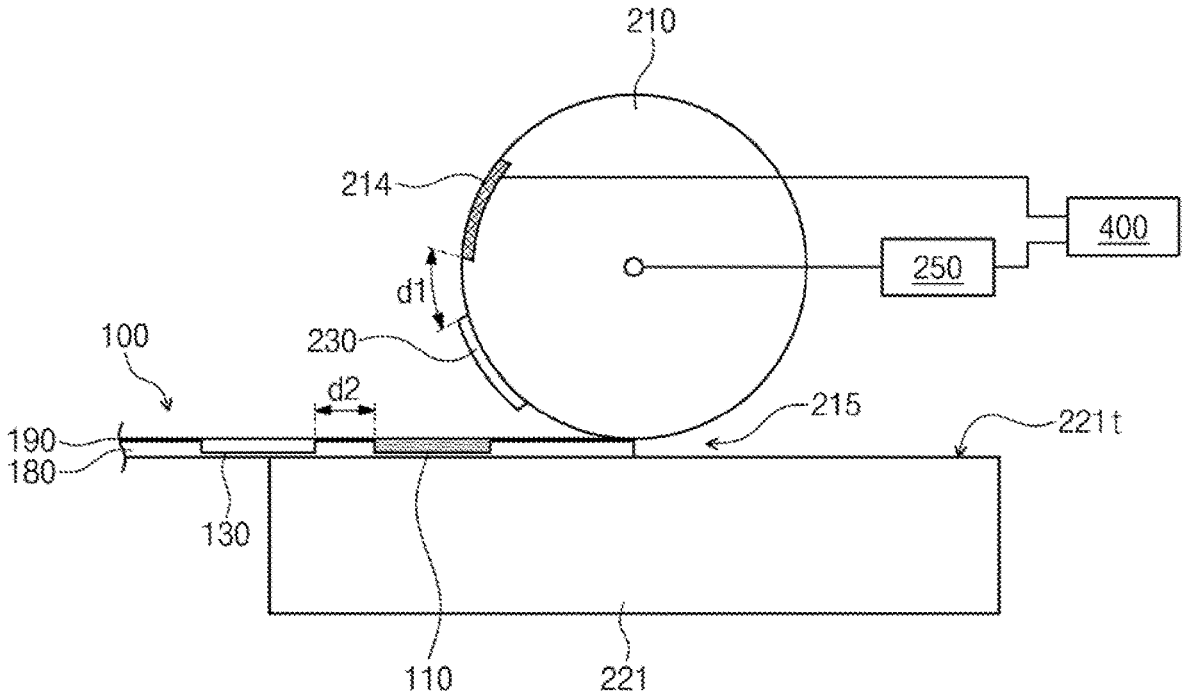
FIG. 10 is a view illustrating a microfluidic control system, according to embodiments of the inventive concept.

FIG. 10 is a view illustrating a microfluidic control system, according to embodiments of the inventive concept. The microfluidic control system of FIG. 10 may be substantially the same as in FIG. 6, except that the second roller 220 of the microfluidic control device 200 of FIG. 6 is replaced with a lower support part 221. A description of the redundant configuration will not be provided for the sake of simplicity.

Referring to FIG. 10, the microfluidic control device 200 may include the lower support part 221. The lower support part 221 may be disposed adjacent to the first roller 210. The lower support part 221 may have a flat plate shape. The lower support part 221 may support the microfluidic chip 100 while the microfluidic chip 100 passes through the microfluidic control device 200. Unlike the case described with reference to FIG. 6, the microfluidic chip 100 may be introduced between the lower support part 221 and the first roller 210. The upper surface 221*t* of the lower support part 221 may be flat and smooth to allow the microfluidic chip 100 to easily move. According to an example, the microfluidic chip 100 may be fixed to the upper surface 221*t* of the lower support part 221, and the lower support part 221 may move in the direction of the first roller 210. The movement speed of the lower support part 221 may be equal to the linear speed of the outer peripheral surface of the first roller 210. The lower support part 221 may be composed of, for example, plastic, glass, metal, or a combination thereof.

Figure 11:
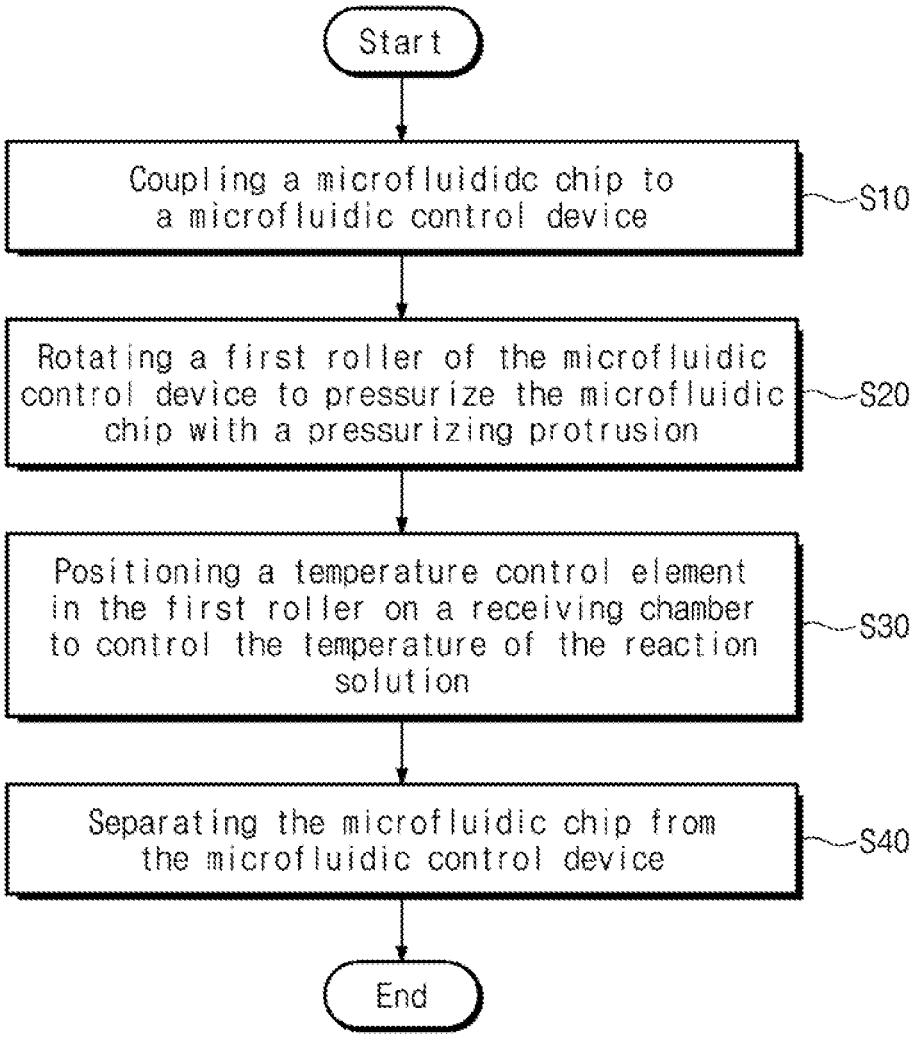
FIG. 11 is a flowchart illustrating a microfluidic control method using the microfluidic control system described with reference to FIGS. 1 to 10.

FIG. 11 is a flowchart illustrating a microfluidic control method for using a microfluidic control system described with reference to FIGS. 1 to 10. FIGS. 12 to 15 are views illustrating a microfluidic control method using a microfluidic control system described with reference to FIGS. 1 to 10.

Figure 12:
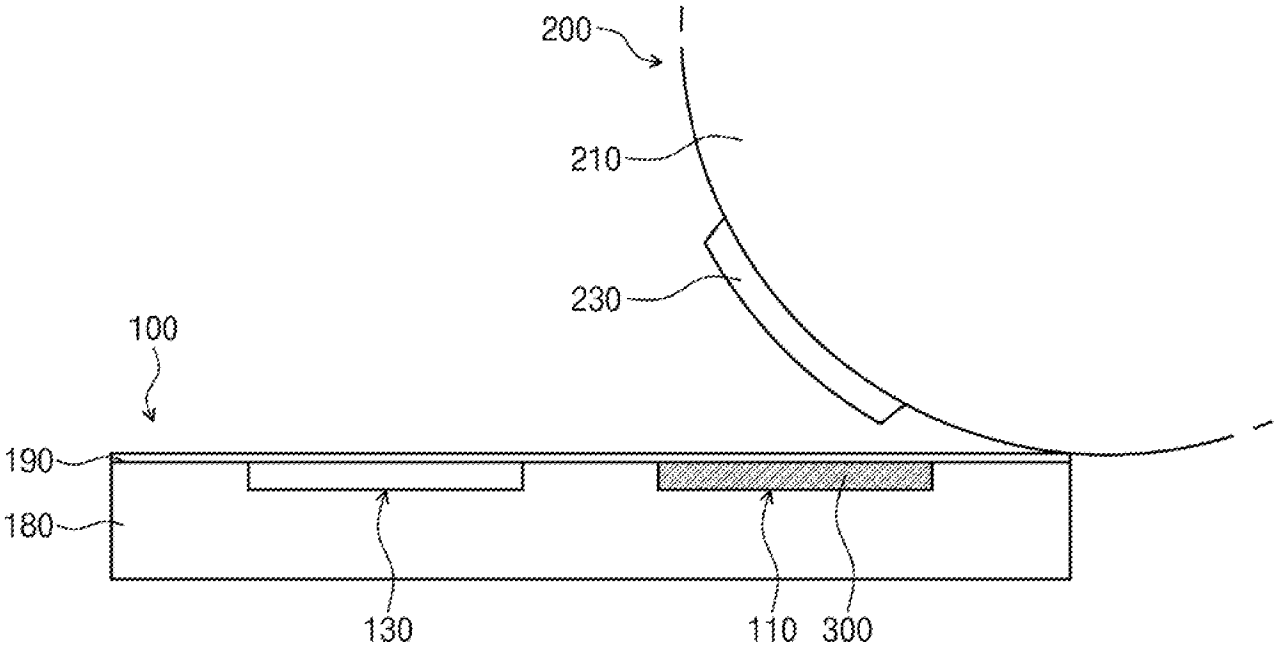
FIGS. 12 to 15 are cross-sectional views illustrating a microfluidic control method using the microfluidic control system described with reference to FIGS. 1 to 10.

Referring to FIGS. 11 and 12, first, the microfluidic control system described with reference to FIGS. 1 to 10 may be prepared. The microfluidic chip 100 may be prepared in a state in which the reaction solution 300 is filled in the storage chamber 110. Subsequently, the microfluidic chip 100 may be coupled to the microfluidic control device 200 at step S10. That is, the microfluidic chip 100 and the first roller 210 may be brought into contact with each other such that the microfluidic chip 100 moves in accordance with the rotation of the first roller 210. As described with reference to FIG. 9, when the microfluidic chip 100 and the microfluidic control device 200 include coupling grooves 102 and coupling protrusions 224, respectively, the coupling protrusions 224 are inserted into the coupling grooves 102, so that the microfluidic chip 100 may be coupled to the microfluidic control device 200.

Referring to FIGS. 11, 13, 14 and 15, the first roller 210 may be rotated to pressurize the storage chamber 110 of the microfluidic chip 100 with the pressurizing protrusion 230 at step S20. That is, the cover sheet 190 may be pressurized with the pressurizing protrusion 230 to apply pressure inside the storage chamber 110. As the pressure is applied inside the storage chamber 110, the reaction solution 300 may be transferred from the storage chamber 110 to the receiving chamber 130.

Figure 13:
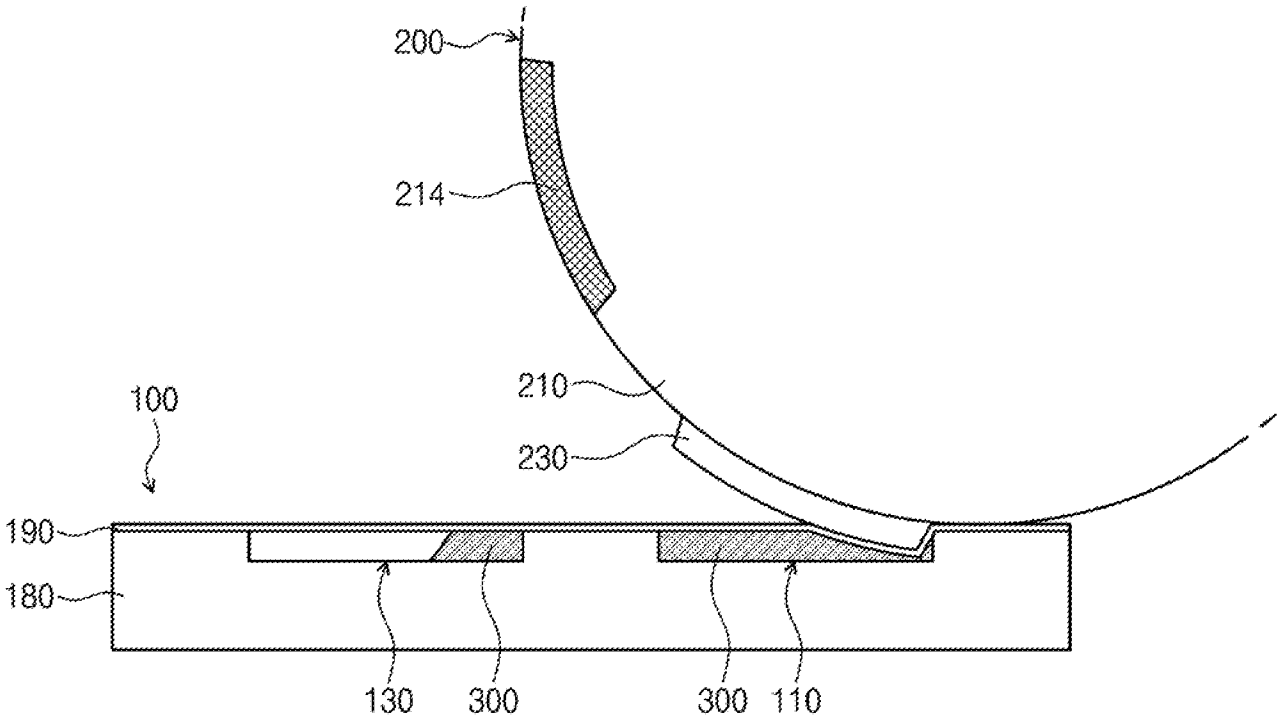
Figure 14:
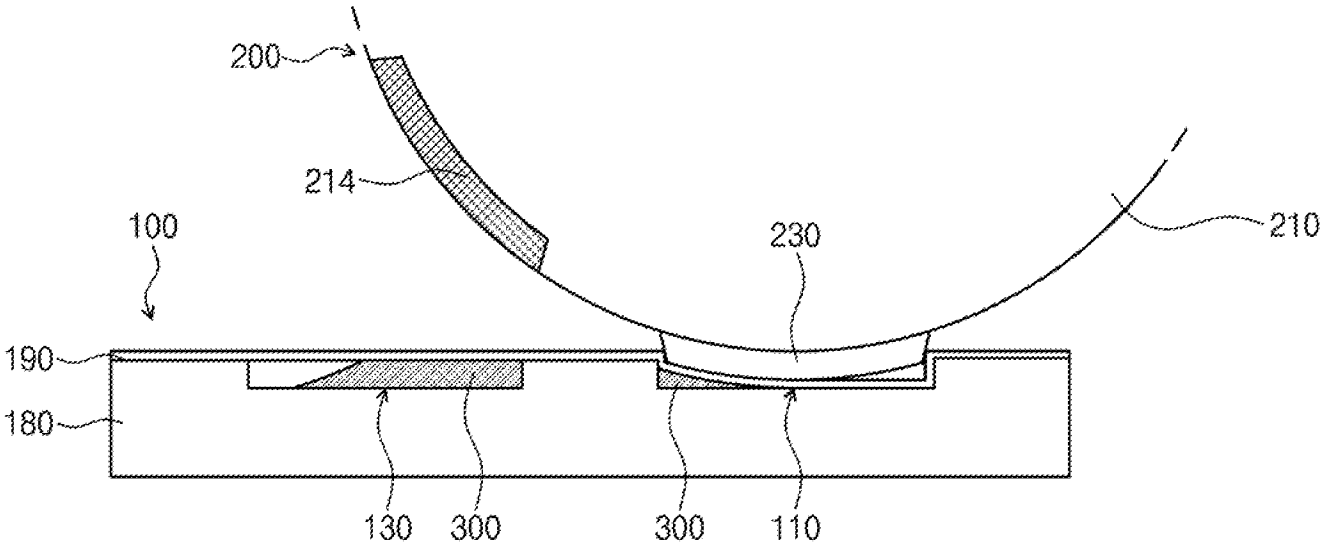
Figure 15:
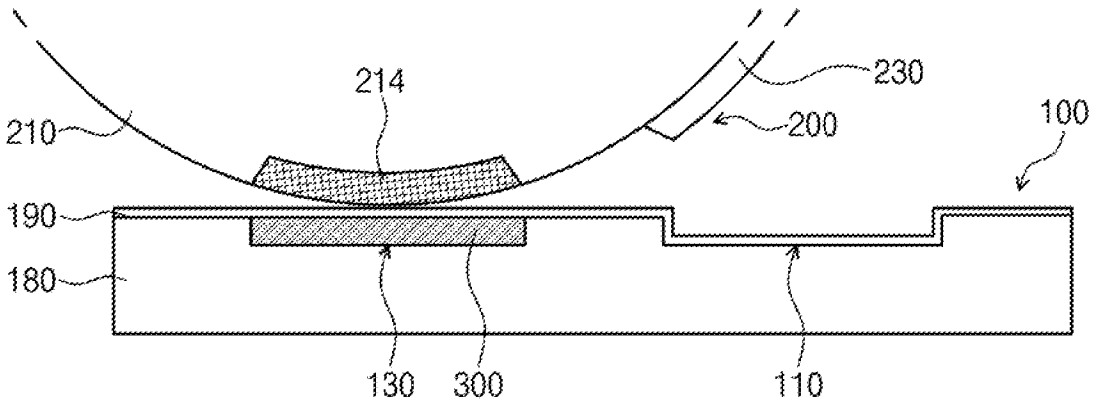

Specifically, the microfluidic chip 100 may move linearly while the first roller 210 rotates. In this case, the first roller 210 and the microfluidic chip 100 come into contact with each other to be coupled, and thus the linear speed of the outer peripheral surface of the first roller 210 may be equal to the movement speed of the microfluidic chip 100. As illustrated in FIG. 13, one surface of the pressurizing protrusion 230 may pressurize the cover sheet 190. Accordingly, a portion of the cover sheet 190 may come in contact with the bottom surface of the storage chamber 110. As the space inside the storage chamber 110 is reduced, the pressure in the storage chamber 110 may be increased, and the reaction solution 300 may be transferred into the receiving chamber 130. Subsequently, as illustrated in FIGS. 14 and 15, the pressurizing protrusion 230 may sequentially contact the cover sheet 190 from one point to the other point of the bottom surface of the storage chamber 110 in accordance with the rotation of the first roller 210. For example, the rotational speed of the first roller 210 may be controlled by the controller 400 described with reference to FIG. 6. Accordingly, the transferred speed of the reaction solution 300 may be controlled.

Next, the pressurizing protrusion 230 may be separated from the storage chamber 110 in accordance with the rotation of the first roller 210. The pressurizing protrusion 230 and the storage chamber 110 are separated from each other, and then the cover sheet 190 may be maintained in a state in which at least a portion of the lower surface of the cover sheet 190 adheres to the bottom surface of the storage chamber 110. Accordingly, the reaction solution 300 may be prevented from flowing back to the storage chamber 110 again. However, the embodiments of the inventive concept are not limited thereto. According to an example, the cover sheet 190 may be composed of a material without a restoring force, and thus may be permanently deformed. When the lower surface of the cover sheet 190 does not have an adhesive force, the cover sheet 190 may be restored in the state before being pressurized by the pressurizing protrusion 230.

Referring to FIGS. 11 and 15, the temperature control part 214 of the first roller 210 is positioned on the receiving chamber 130, and thus may control the temperature of the reaction solution 300 at step S30. As described with reference to FIG. 6, on the outer peripheral surface of the first roller 210, the distance between the temperature control part 214 and the pressurizing protrusion 230 is substantially equal to the distance between the storage chamber 110 and the receiving chamber 130, and thus the first roller 210 may be rotated to position the temperature control part 214 on the receiving chamber 130. Then, the reaction solution 300 may be heated or cooled by using the temperature control part 214.

The microfluidic chip 100 may be separated from the microfluidic control device 200 at step S40. The first roller 210 may be rotated to draw in a direction opposite to the direction in which the microfluidic chip 100 is introduced.

According to an embodiment of the inventive concept, there may be provided a microfluidic control system capable of precisely controlling a reaction solution and transferring various kinds of reaction solutions.

According to an embodiment of the inventive concept, there may be provided a microfluidic control method which is simple, inexpensive, and capable of easily controlling the transferred speed of microfluid.

As described above, while the embodiments of the present disclosure have been described with reference to the accompanying drawings, it will be understood by those skilled in the art that the present disclosure may be embodied in other specific forms without departing from the spirit or essential characteristics thereof. It is therefore to be understood that the embodiments described above are in all respects illustrative and not restrictive.

What is claimed is:

1. A microfluidic control system for processing a reaction solution, the system comprising:

a microfluidic chip comprising a storage chamber for storing a reaction solution and a receiving chamber communicating with the storage chamber; and a microfluidic control device for controlling the reaction solution inside the microfluidic chip, wherein the microfluidic control device comprises:

a first roller which is in contact with the microfluidic chip and rotates together with the movement of the microfluidic chip;

a pressurizing protrusion that protrudes from an outer peripheral surface of the first roller, wherein the pressurizing protrusion has a shape corresponding to the storage chamber; and a temperature control part disposed inside the first roller under the outer peripheral surface, wherein on the outer peripheral surface of the first roller, a distance between the temperature control part and the pressurizing protrusion is substantially equal to the distance between the storage chamber and the receiving chamber.

2. The microfluidic control system of claim 1, wherein the microfluidic chip comprises a body part and a cover sheet covering the body part, wherein the storage chamber is defined by the body part and the cover sheet.

3. The microfluidic control system of claim 2, wherein the cover sheet is composed of a material having elasticity.

4. The microfluidic control system of claim 2, wherein the microfluidic chip further comprises an adhesive layer on one surface of the cover sheet facing the body part.

5. The microfluidic control system of claim 1, wherein the microfluidic chip further comprises an exhaust hole for exhausting air inside the microfluidic chip, wherein the exhaust hole communicates with the receiving chamber.

6. The microfluidic control system of claim 5, wherein the microfluidic chip comprises a body part and a cover sheet covering the body part, wherein the exhaust hole is formed inside the cover sheet and communicates with the receiving chamber through an exhaust channel formed inside the body part.

7. The microfluidic control system of claim 1, wherein the support is a second roller disposed adjacent to the first roller, wherein the microfluidic chip is introduced into the gap between the first roller and the second roller, and the first roller and the second roller rotate together keeping pace with the movement of the microfluidic chip.

8. The microfluidic control system of claim 7, wherein the microfluidic control device further comprises an elastic member disposed inside the second roller and constituting a portion of the outer peripheral surface of the second roller.

9. The microfluidic control system of claim 1, wherein the microfluidic control device further comprises a driving member, wherein the driving member is configured to apply a rotational force to the first roller.

10. The microfluidic control system of claim 1, wherein the storage chamber and the pressurizing protrusion have tapered shapes.

11. A method for processing a reaction solution in a microfluidic chip including a storage chamber for storing the reaction solution and a receiving chamber communicating with the storage chamber, the method comprising:

coupling the microfluidic chip with the reaction solution to a microfluidic control device including a first roller and a pressurizing protrusion formed on an outer peripheral surface of the first roller; and transferring the reaction solution to the storage chamber by rotating the first roller to pressurize the storage chamber with the pressurizing protrusion.

12. The method of claim 11, wherein the microfluidic chip comprises a body part and a cover sheet covering the body part, and the storage chamber is defined by the body part and the cover sheet, wherein the pressurizing the storage chamber includes pressurizing the cover sheet with the pressurizing protrusion.

13. The method of claim 12, wherein the pressurizing the cover sheet with the pressurizing protrusion comprises sequentially contacting the cover sheet from one point to another point on a bottom surface of the storage chamber by using the pressurizing protrusion.

14. The method of claim 12, wherein the pressurizing allows at least a portion of one surface of the cover sheet facing the body part to adhere to a bottom surface of the storage chamber.

15. The method of claim 11, wherein the microfluidic chip moves linearly while the first roller rotates, wherein a linear speed of the outer peripheral surface of the first roller is equal to a linear speed of the microfluidic chip.

16. The method of claim 11, wherein the microfluidic control device further comprises a temperature control part disposed inside the first roller, wherein the temperature control part is positioned on the receiving chamber to control a temperature of the reaction solution transferred to the receiving chamber.

* * * * *